US009196137B2

(12) United States Patent
Shapira et al.

(10) Patent No.: US 9,196,137 B2
(45) Date of Patent: Nov. 24, 2015

(54) TWO-WAY WIRELESS COMMUNICATION ENABLED INTRUSION DETECTOR ASSEMBLIES

(71) Applicant: Tyco Fire & Security GmbH, Newhausen am Rheinfall (CH)

(72) Inventors: Alexander Shapira, Petakh Tikva (IL); Yizhaq Pinhas, Shoham (IL)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 82 days.

(21) Appl. No.: 14/153,135

(22) Filed: Jan. 13, 2014

(65) Prior Publication Data

US 2015/0199888 A1 Jul. 16, 2015

(51) Int. Cl.

| | |
|---|---|
| ***G08B 13/08*** | (2006.01) |
| ***H01Q 1/48*** | (2006.01) |
| ***H01Q 9/26*** | (2006.01) |
| ***H01Q 9/40*** | (2006.01) |
| ***H01Q 9/42*** | (2006.01) |

(52) U.S. Cl.

CPC ..... *G08B 13/08* (2013.01); *H01Q 1/48* (2013.01); *H01Q 9/26* (2013.01); *H01Q 9/40* (2013.01); *H01Q 9/42* (2013.01)

(58) Field of Classification Search

CPC ..... H01Q 9/26; H01Q 9/40; H01Q 9/42; H01Q 1/48; G08B 13/08; G08B 25/10; G08B 25/008

USPC ..... 340/547, 541, 542; 343/803, 848

See application file for complete search history.

(56) References Cited

U.S. PATENT DOCUMENTS

| | | | | |
|---|---|---|---|---|
| 5,164,705 | A * | 11/1992 | Dunagan et al. | 340/547 |
| 5,392,025 | A * | 2/1995 | Figh et al. | 340/547 |
| 6,400,267 | B1 * | 6/2002 | Gordon-Levitt et al. | 340/547 |
| 6,583,769 | B2 | 6/2003 | Shiroki et al. | |
| 6,737,969 | B2 | 5/2004 | Carlson et al. | |
| 7,081,816 | B2 | 7/2006 | Schebel et al. | |
| 7,102,220 | B2 | 9/2006 | Stevens et al. | |
| 7,342,540 | B2 | 3/2008 | Nahar | |
| 7,352,326 | B2 | 4/2008 | Korva | |
| 7,692,595 | B2 | 4/2010 | Kim | |
| 7,805,689 | B2 | 9/2010 | Ueda et al. | |
| 7,967,216 | B2 | 6/2011 | Kato et al. | |
| 8,193,988 | B2 | 6/2012 | Thudor | |
| 8,624,736 | B2 * | 1/2014 | Gore et al. | 340/547 |

(Continued)

OTHER PUBLICATIONS

MC-302V Supervised PowerG Vanishing Magnetic Contact Device, Visonic LTD. (2013).

(Continued)

*Primary Examiner* — John A Tweel, Jr.
(74) *Attorney, Agent, or Firm* — HoustonHogle, LLP

(57) ABSTRACT

A wireless door intrusion detection assembly including a magnet component installed on a door, and a fixed magnetic contact wireless transceiver component installed on a door frame corresponding to the door, opposite the magnet component, the fixed magnetic contact wireless transceiver component including a two-way transceiver element operable for two-way wireless communication between the fixed magnetic contact wireless transceiver component and an intrusion alarm system, an antenna facilitating the two-way wireless communication between the fixed magnetic contact wireless transceiver component and the intrusion alarm system, and an antenna ground reference plane, opposite the antenna.

59 Claims, 9 Drawing Sheets

(56) References Cited

U.S. PATENT DOCUMENTS

| | | | | |
|---|---|---|---|---|
| 2005/0237255 | A1 | 10/2005 | Zhang | |
| 2011/0057851 | A1 | 3/2011 | Chung | |
| 2013/0200162 | A1 | 8/2013 | Dokai et al. | |
| 2013/0257611 | A1* | 10/2013 | Lamb et al. | 340/501 |
| 2015/0048944 | A1* | 2/2015 | Chen | 340/542 |

OTHER PUBLICATIONS

Sensors & Accessories ,Wireless Vanishing Door/Window contact EV-DW4975 (Jan. 2008).

Honeywell's 5811 Thin Door/Window Contact Transmitter (May 2009).

Federal Communications Commission , Part 15—Radio Frequency Devices ,47 CFR Ch. I, pp. 751-870 (Oct. 1, 2009 Edition).

European Standard ,ETSI EN 300 220-1 V2.4.1, Electromagnetic compatibility and Radio spectrum Matters (ERM); Short Range Devices (SRD); Radio equipment to be used in the 25 MHz to 1 000 MHz frequency range with power levels ranging up to 500 mW; Part 1: Technical characteristics and test methods (May 2012).

Harmonized European Standard, ETSI EN 300 220-2 V2.4.1, Electromagnetic compatibility and Radio spectrum Matters (ERM); Short Range Devices (SRD); Radio equipment to be used in the 25 MHz to 1 000 MHz frequency range with power levels ranging up to 500 mW; Part 2: Harmonized EN covering essential requirements under article 3.2 of the R&TTE Directive (May 2012).

Neo Brochure: "PowerSeries Neo, With PowerSeries Neo products, no measures are spared to achieve stellar industry standards". (2013).

PowerG Booklet: "Taking Wireless Security", by Visonic (2013).

EV-DW4975 Vanishing Door/Window Contact Installation Manual (2006).

* cited by examiner

TWO-WAY WIRELESS COMMUNICATION ENABLED INTRUSION DETECTOR ASSEMBLIES

FIELD OF THE INVENTION

The present invention relates to two-way wireless communication enabled intrusion detectors and intrusion detector assemblies.

BACKGROUND OF THE INVENTION

Intrusion detectors typically employed in door or window intrusion detector assemblies are typically prone to be visible to potential intruders. It is therefore advantageous to provide intrusion detectors which are small and easy to conceal.

Additionally, it is advantageous to provide intrusion detectors which communicate with a central alarm system via wireless communication, thereby eliminating the need for installation of communication wiring.

It is further advantageous to provide intrusion detectors which communicate wirelessly via a two-way communication system, thereby facilitating for more reliable communication that is less prone to interference or blocking.

The present invention therefore seeks to provide an intrusion detector assembly having a narrow physical profile, while providing intrusion detection capabilities and two-way wireless communication functionality for communicating with an alarm system.

SUMMARY OF THE INVENTION

The present invention seeks to provide improved two-way wireless communication enabled intrusion detectors and intrusion detector assemblies.

There is thus provided in accordance with a preferred embodiment of the present invention a wireless door intrusion detection assembly including a magnet component installed on a door, and a fixed magnetic contact wireless transceiver component installed on a door frame corresponding to the door, opposite the magnet component, the fixed magnetic contact wireless transceiver component including a two-way transceiver element operable for two-way wireless communication between the fixed magnetic contact wireless transceiver component and an intrusion alarm system, an antenna facilitating the two-way wireless communication between the fixed magnetic contact wireless transceiver component and the intrusion alarm system, and an antenna ground reference plane, opposite the antenna.

Preferably, the antenna includes a flat elongate portion, first and second downward folded end portions extending downwardly from corresponding first and second ends of the flat elongate portion, a folded side portion extending outwardly from a side edge of the flat elongate portion, and an extended folded side portion extending outwardly from the side edge of the flat elongate portion.

Preferably, the antenna ground reference plane includes a flat elongate portion, first and second downward folded end portions extending downwardly from corresponding first and second ends of the flat elongate portion, and an elongate folded side portion extending from a side edge of the flat elongate portion.

Preferably, the flat elongate portion has a volume of 10.08 cubic millimeters. Additionally, the flat elongate portion has a length of 25.2 millimeters, a width of 2.0 millimeters and a thickness of 0.2 millimeters, each of the first and second downward folded end portions has a width of 2.0 millimeters and a thickness of 0.2 millimeters, and extends downwardly 1.1 millimeters from the corresponding first and second ends of the flat elongate portion, the folded side portion extends outwardly 0.4 millimeters and downwardly 0.9 millimeters from the side edge of the flat elongate portion, the distance between a far end of the second downward folded end portion and an opposite far end of the folded side portion being 13.6 millimeters, and the extended folded side portion extends outwardly 1.8 millimeters and downwardly 1.1 millimeters from the side edge of the flat elongate portion, the distance between the far end of the second folded end portion and the opposite far end of the folded side portion being 5.8 millimeters.

Preferably, the first downward folded end portion is connected via a capacitor to ground. Preferably, the second downward folded end portion is grounded. Preferably, the extended folded side portion serves as an input\output port of the antenna.

Preferably, the flat elongate portion has a volume of 15.972 cubic millimeters. Additionally, the flat elongate portion has a length of 24.2 millimeters, a width of 3.3 millimeters and a thickness of 0.2 millimeters, each of the first and second downward folded end portions has a width of 3.3 millimeters and a thickness of 0.2 millimeters, and extends downwardly 1.1 millimeters from the corresponding first and second ends of the flat elongate portion, and the elongate folded side portion extends outwardly 0.5 millimeters and downwardly 1.1 millimeters from the side edge of the flat elongate portion.

Preferably, the wireless door intrusion detection assembly also includes a REED switch operable for sensing changes in a magnetic field induced by the magnet component, the changes being potentially indicative of an intrusion, and communicating indications of the changes to the alarm system via the two-way transceiver component.

Preferably, the magnet component includes a contact component installation marker for alignment thereof with a corresponding transceiver component installation marker included on the fixed magnetic contact wireless transceiver component, upon installation of the magnet component and the fixed magnetic contact wireless transceiver component in the door assembly.

Preferably, the fixed magnetic contact wireless transceiver component also includes top and bottom housing elements. Preferably, the fixed magnetic contact wireless transceiver component also includes a recess which facilitates removal of the bottom housing element from the fixed magnetic contact wireless transceiver component.

Preferably, the top housing element includes at least one of at least one snap-in element and at least one retaining element integrally formed therein, for tightly retaining the two-way transceiver element within the top and bottom housing elements. Additionally, the top housing element includes a battery housing element for housing a battery, and at least one of at least one snap-in element and at least one retaining element operable for retaining the battery within the battery housing. Preferably, the battery housing element includes at least one battery engaging element and at least one battery circuit engaging element, and the two-way transceiver element includes at least one transceiver circuit engaging element, the battery engaging element being operable for galvanically connecting a negative contact of the battery with the at least one battery circuit engaging element, the at least one battery circuit engaging element being operable for galvanic engagement with the at least one transceiver circuit engaging element of the two-way transceiver element upon enclosing the two-way transceiver element within the housing elements.

Preferably, apertures for receiving the at least one of at least one snap-in element and at least one retaining element are formed in the bottom housing element. Additionally or alternatively, apertures for facilitating fastening of the fixed magnetic contact wireless transceiver component to the door frame are formed in the bottom housing element.

Preferably, the fixed magnetic contact wireless transceiver component also includes a tamper switch, wherein an attempt to tamper with the fixed magnetic contact wireless transceiver component upon being fastened to the door frame results in toggling of the tamper switch. Preferably, the fixed magnetic contact wireless transceiver component also includes an operator button operable for initiating, by an operator of the alarm system, communication of the fixed magnetic contact wireless transceiver component with the alarm system upon at least one of installation of the fixed magnetic contact wireless transceiver component and maintenance thereof.

Preferably, the two-way transceiver element includes a battery engaging element operable for engaging a positive contact of the battery.

Preferably, the antenna is configured for high frequency communication with the alarm system, the high frequency being one of 868 MHz and 915 MHz. Preferably, the antenna ground reference plane opposite the antenna is operative to improve the gain of the antenna and to diminish interfering effects of materials disposed in a vicinity of the fixed magnetic contact wireless transceiver component. Preferably, the materials include metals, and the interfering effects include at least one of mistuning of the antenna, degradation of performance of the antenna and degradation of a range of the antenna.

Preferably, the fixed magnetic contact wireless transceiver component also includes a LED indicator operative to provide visual indications of a status of the fixed magnetic contact wireless transceiver component to an operator of the fixed magnetic contact wireless transceiver component. Preferably, the visual indications include an indication of communication signal strength of the fixed magnetic contact wireless transceiver component. Preferably, the LED indicator is operable to provide the visual indications in a multiplicity of colors.

There is also provided in accordance with another preferred embodiment of the present invention a wireless door intrusion detection assembly including a magnet component installed on a door and a fixed magnetic contact wireless transceiver component installed on a door frame corresponding to the door, opposite the magnet component, the fixed magnetic contact wireless transceiver component including a two-way transceiver component operable for two-way wireless communication between the fixed magnetic contact wireless transceiver component and an intrusion alarm system, and an L-shaped antenna facilitating the two-way wireless communication between the fixed magnetic contact wireless transceiver component and the intrusion alarm system.

Preferably, the L-shaped antenna includes a long flat elongate portion and a short flat elongate portion perpendicular to the long flat elongate portion, the long flat elongate portion and the short flat elongate portion having a combined volume of 19.8 cubic millimeters. Additionally, the long flat elongate portion has a length of 33.3 millimeters, a width of 2.0 millimeters and a thickness of 0.2 millimeters, and the short flat elongate portion has a length of 18.2 millimeters, a width of 2.0 millimeters and a thickness of 0.2 millimeters.

Preferably, the L-shaped antenna also includes a first downward folded end portion extending downwardly from an end of the long flat elongate portion, a first folded side portion extending outwardly and downwardly from a side edge of the long flat elongate portion, a second downward folded end portion extending downwardly from an end of the short flat elongate portion, and a second folded side portion extending outwardly and downwardly from a side edge of the short flat elongate portion.

Additionally, the first downward folded end portion has a width of 2.0 millimeters and a thickness of 0.2 millimeters, and extends downwardly 1.1 millimeters from the end of the long flat elongate portion, the first folded side portion extends outwardly 0.4 millimeters and downwardly 1.1 millimeters from the side edge of the long flat elongate portion, the distance between a far end of the first folded end portion and a near end of the first folded side portion being 24.3 millimeters, the second downward folded end portion has a width of 2.0 millimeters and a thickness of 0.2 millimeters, and extends downwardly 1.1 millimeters from the end of the short flat elongate portion, and the second folded side portion extends outwardly 0.4 millimeters and downwardly 1.1 millimeters from the side edge of the short flat elongate portion, the distance between a far end of the second folded end portion and a near end of the second folded side portion being 3.5 millimeters.

Preferably, the first downward folded end portion is connected via a capacitor to ground. Preferably, the second downward folded end portion is grounded. Preferably, the second folded side portion serves as an input\output port of the antenna.

Preferably, the wireless door intrusion detection assembly also includes a REED switch operable for sensing changes in a magnetic field induced by the magnet component, the changes being potentially indicative of an intrusion, and communicating indications of the changes to the alarm system via the two-way transceiver component.

Preferably, the magnet component includes a contact component installation marker for alignment thereof with a corresponding transceiver component installation marker included on the fixed magnetic contact wireless transceiver component, upon installation of the magnet component and the fixed magnetic contact wireless transceiver component in the door assembly.

Preferably, the fixed magnetic contact wireless transceiver component also includes top and bottom housing elements. Preferably, the fixed magnetic contact wireless transceiver component also includes a recess which facilitates removal of the bottom housing element from the fixed magnetic contact wireless transceiver component.

Preferably, the top housing element includes at least one of at least one snap-in element and at least one retaining element integrally formed therein, for tightly retaining the two-way transceiver element within the top and bottom housing elements. Additionally, the top housing element includes a battery housing element for housing a battery, and at least one of at least one snap-in element and at least one retaining element operable for retaining the battery within the battery housing. Preferably, the battery housing element includes at least one battery engaging element and at least one battery circuit engaging element, and the two-way transceiver element includes at least one transceiver circuit engaging element, the battery engaging element being operable for galvanically connecting a negative contact of the battery with the at least one battery circuit engaging element, the at least one battery circuit engaging element being operable for galvanic engagement with the at least one transceiver circuit engaging element of the two-way transceiver element upon enclosing the two-way transceiver element within the housing elements.

Preferably, apertures for receiving the at least one of at least one snap-in element and at least one retaining element are formed in the bottom housing element. Additionally or alternatively, apertures for facilitating fastening of the fixed magnetic contact wireless transceiver component to the door frame are formed in the bottom housing element.

Preferably, the fixed magnetic contact wireless transceiver component also includes a tamper switch, wherein an attempt to tamper with the fixed magnetic contact wireless transceiver component upon being fastened to the door frame results in toggling of the tamper switch. Preferably, the fixed magnetic contact wireless transceiver component also includes an operator button operable for initiating, by an operator of the alarm system, communication of the fixed magnetic contact wireless transceiver component with the alarm system upon at least one of installation of the fixed magnetic contact wireless transceiver component and maintenance thereof.

Preferably, the two-way transceiver element includes a battery engaging element operable for engaging a positive contact of the battery.

Preferably, the antenna is configured for low frequency communication with the alarm system, the low frequency being 433 MHz. Preferably, the antenna ground reference plane opposite the antenna is operative to improve the gain of the antenna and to diminish interfering effects of materials disposed in a vicinity of the fixed magnetic contact wireless transceiver component. Preferably, the materials include metals, and the interfering effects include at least one of mistuning of the antenna, degradation of performance of the antenna and degradation of a range of the antenna.

Preferably, the fixed magnetic contact wireless transceiver component also includes a LED indicator operative to provide visual indications of a status of the fixed magnetic contact wireless transceiver component to an operator of the fixed magnetic contact wireless transceiver component. Preferably, the visual indications include an indication of communication signal strength of the fixed magnetic contact wireless transceiver component. Preferably, the LED indicator is operable to provide the visual indications in a multiplicity of colors.

BRIEF DESCRIPTION OF THE DRAWINGS

The present invention will be understood and appreciated more fully from the following detailed description taken in conjunction with the drawings in which.

DETAILED DESCRIPTION OF PREFERRED EMBODIMENTS

Figure 1A:
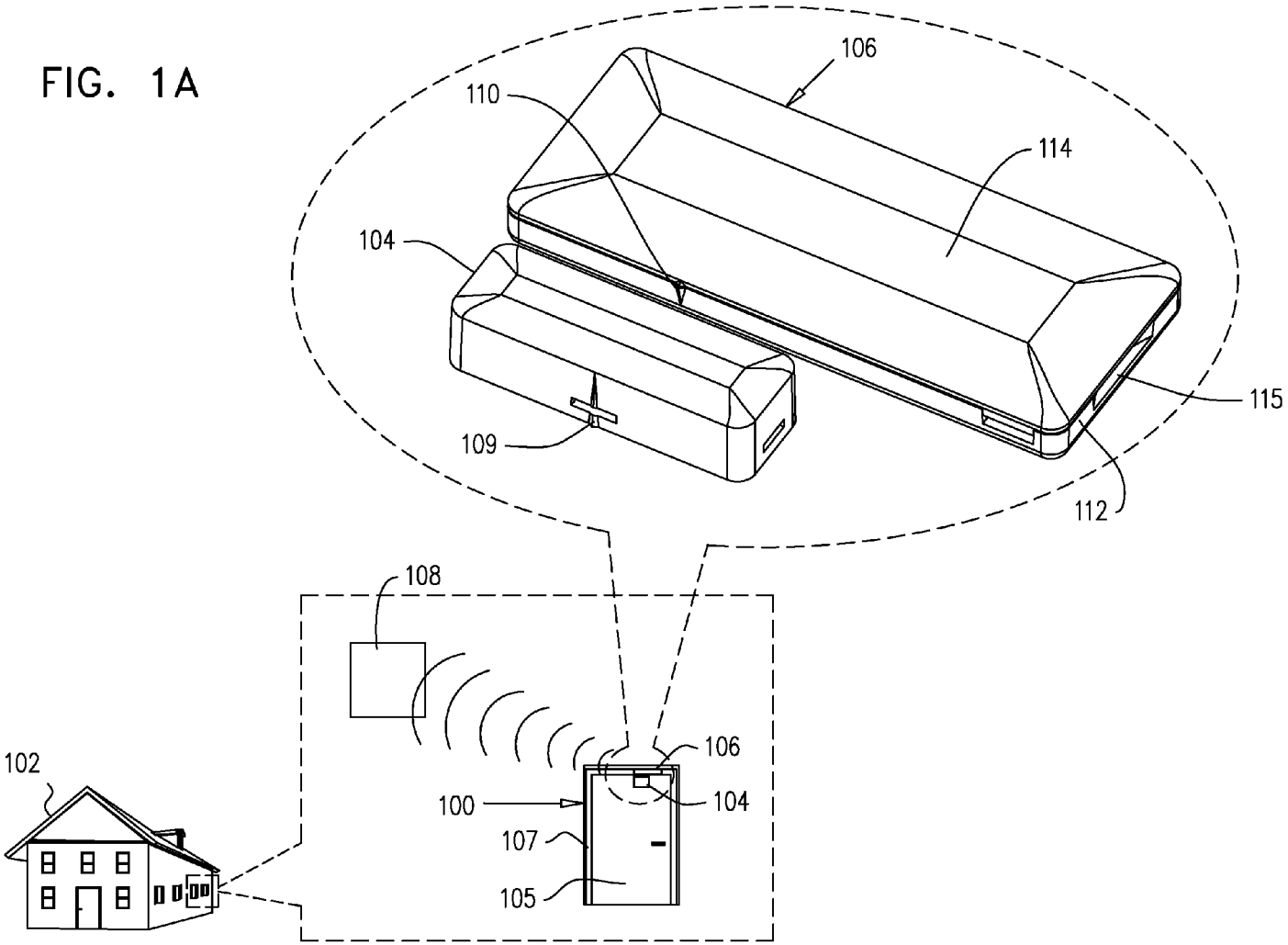
FIG. 1A is a simplified pictorial illustration of a wireless door\window magnetic contact transceiver for use in a door intrusion detection assembly, constructed and operative in accordance with a preferred embodiment of the present invention.
Figure 1B:
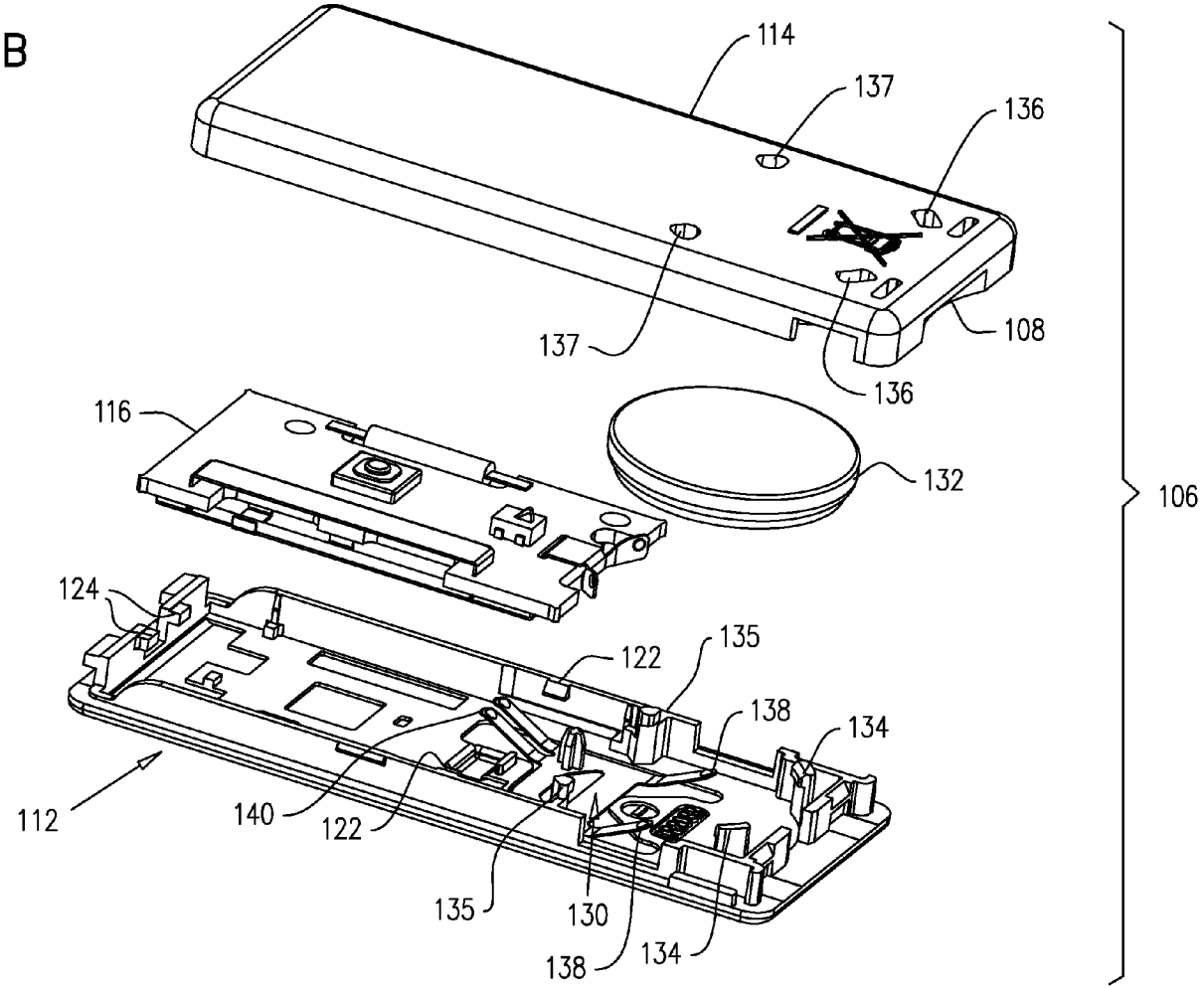
FIG. 1B is a simplified exploded view illustration of the wireless door\window magnetic contact transceiver of FIG. 1A.

Reference is now made to FIG. 1A, which is a simplified pictorial illustration of a wireless door\window magnetic contact transceiver for use in a door\window intrusion detection assembly, constructed and operative in accordance with a preferred embodiment of the present invention, and to FIG. 1B, which is a simplified exploded view illustration of the wireless door\window magnetic contact transceiver of FIG. 1A.

As shown in FIG. 1A, a door intrusion detection assembly 100 of a residence 102 preferably includes a magnet component 104 installed on a door 105 and a fixed magnetic contact wireless transceiver component 106 installed on a corresponding door frame 107. Fixed magnetic contact wireless transceiver component 106 is preferably operable for wirelessly communicating with an alarm system 108 protecting home 102.

It is appreciated that magnet component 104 and fixed magnetic contact wireless transceiver component 106 are of a narrow physical profile, thereby facilitating concealment of magnet component 104 and fixed magnetic contact wireless transceiver component 106 from potential intruders.

A contact component installation marker 109 is preferably provided on magnet component 104 for alignment with a corresponding transceiver component installation marker 110 provided on wireless transceiver component 106 upon installation of magnet component 104 and wireless transceiver component 106 in door assembly 100.

Fixed magnetic contact wireless transceiver component 106 preferably includes Top and bottom housing elements 112 and 114. A recess 115 facilitates removal of bottom housing element 114 from fixed magnetic contact wireless transceiver component 106.

Turning now to FIG. 1B, it is shown that fixed magnetic contact wireless transceiver component 106 also includes a two-way transceiver element 116. Snap-in elements 122 and retaining elements 124 are preferably integrally formed in top housing element 112 for tightly retaining two-way transceiver element 116 within housing elements 112 and 114.

Top housing element 112 preferably includes a battery housing element 130 for housing a battery 132, which is preferably retained within battery housing 130 by a pair of snap-in elements 134 and a pair of retaining elements 135. Apertures 136 are formed in bottom housing element 114 for receiving snap-in elements 134 and apertures 137 are formed in bottom housing element 114 for receiving retaining elements 135.

Battery engaging elements 138 are preferably formed in battery housing element 130 for galvanically connecting a negative contact of battery 132 with battery circuit engaging elements 140. Circuit engaging elements 140 are preferably configured for galvanic engagement with transceiver circuit engaging elements of two-way transceiver element 116 upon enclosing two-way transceiver element 116 within housing elements 112 and 114.

Figure 1C:
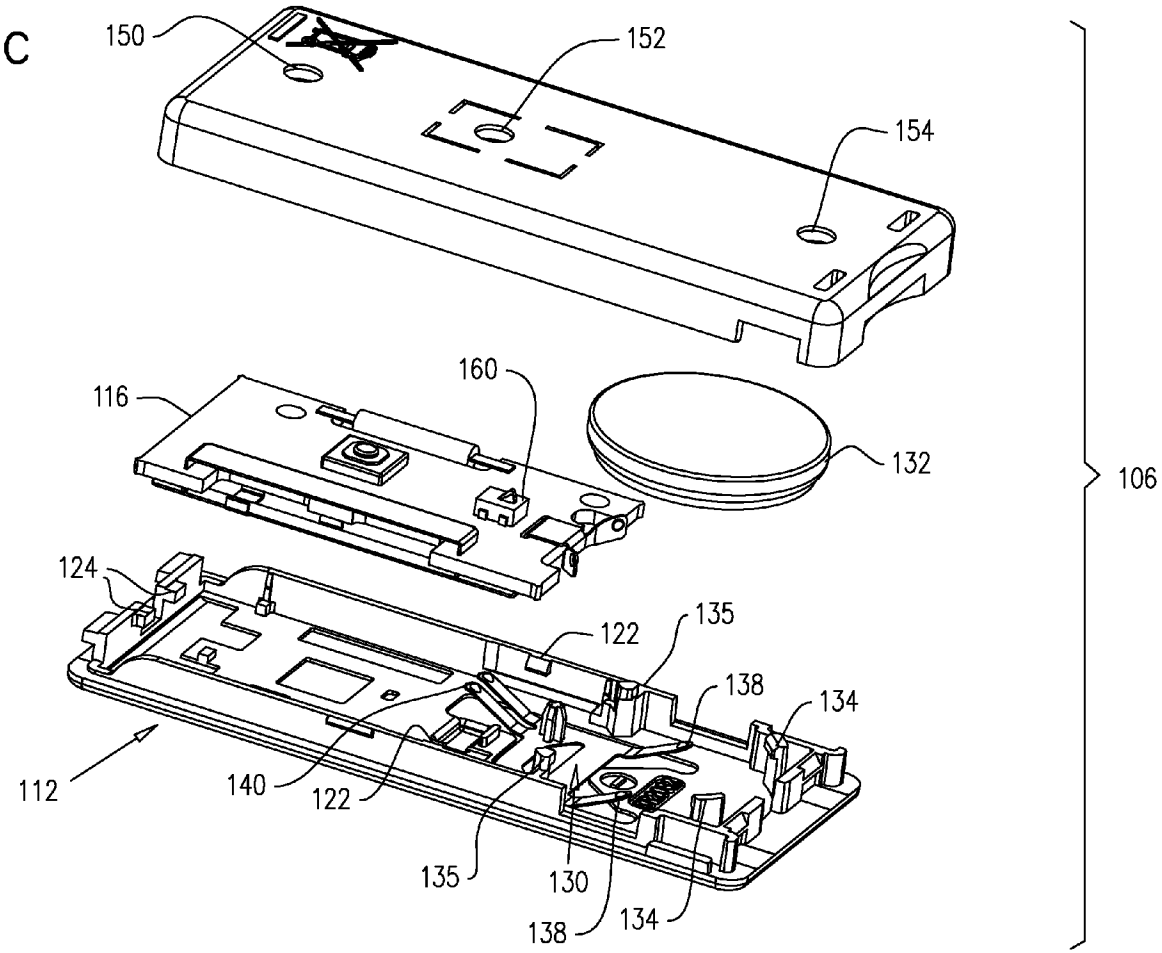
FIG. 1C is a simplified exploded view illustration of the wireless door\window magnetic contact transceiver of FIG. 1A, constructed and operative in accordance with an alternative embodiment of the present invention.

Reference is now made to FIG. 1C, which is a simplified exploded view illustration of the wireless door\window magnetic contact transceiver of FIG. 1A, constructed and operative in accordance with an alternative embodiment of the present invention.

In the embodiment of FIG. 1C, apertures 150, 152 and 154 are provided in bottom housing element 114 for facilitating fastening, by fastening elements such as screws, of wireless transceiver component 106 to door frame 107. It is appreciated that attempts to tamper with wireless transceiver component 106 upon being fastened to door frame 107 will result in toggling of a tamper switch 160 provided on two-way transceiver element 116.

Figure 2A:
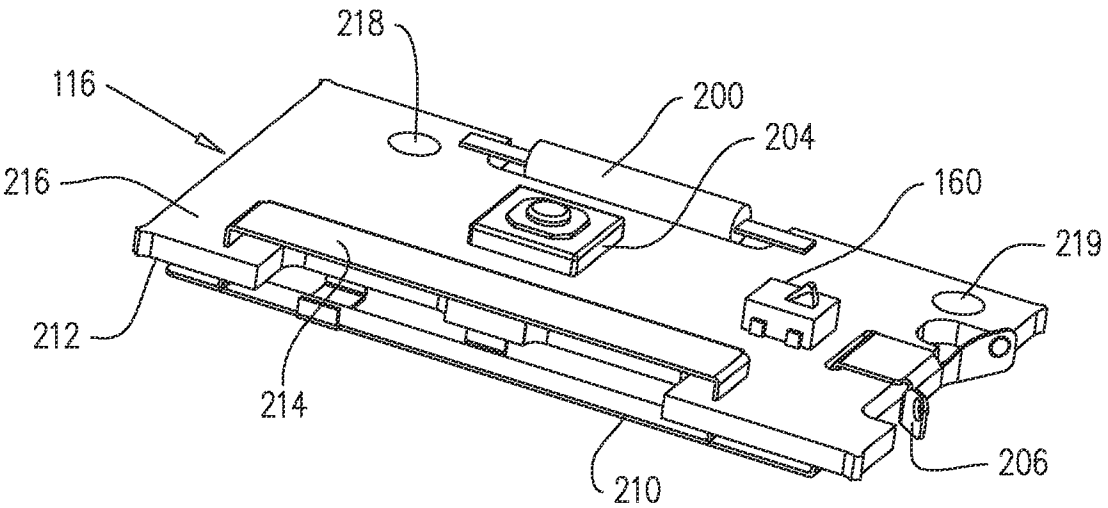
FIGS. 2A & 2B are respective bottom and top view illustrations of a two-way transceiver element of the wireless door\window magnetic contact transceiver of FIGS. 1A-1C, constructed and operative in accordance with the preferred embodiment of the present invention.
Figure 2B:
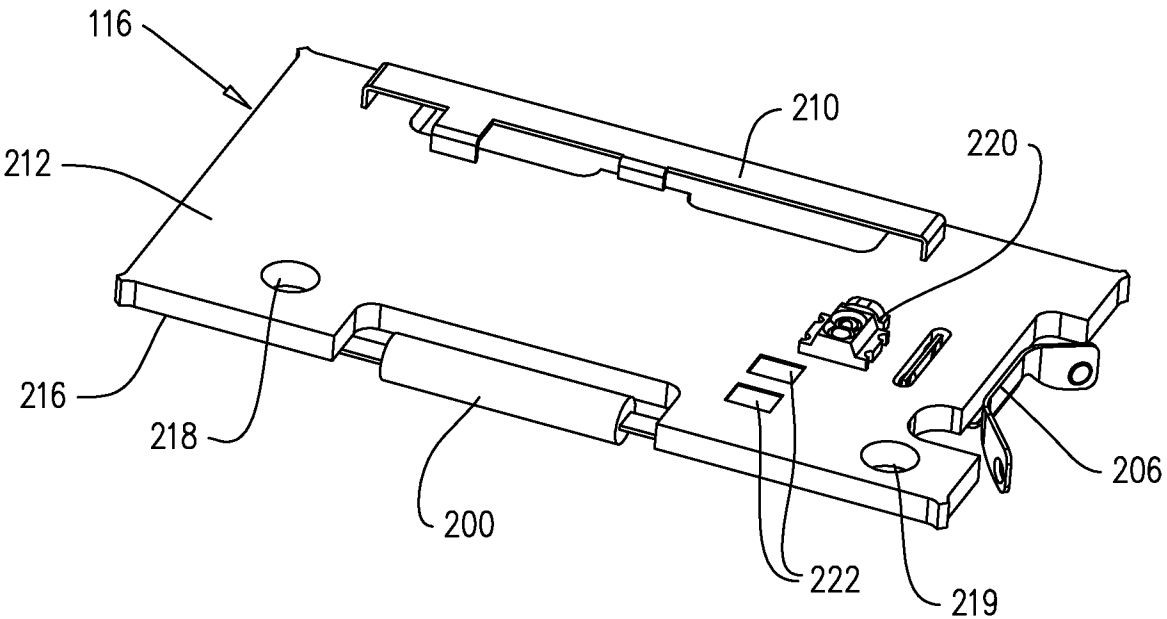

Reference is now made to FIGS. 2A & 2B, which are respective bottom and top view illustrations of two-way transceiver element 116 of the wireless door\window magnetic contact transceiver of FIGS. 1A-1C, constructed and operative in accordance with the preferred embodiment of the present invention.

As shown in particular in FIG. 2A, a REED switch 200 is provided for sensing changes in a magnetic field induced by magnet component 104 of door intrusion detection assembly 100 (FIG. 1A) installed in close proximity thereto. It is appreciated that opening of door 105 upon which magnet component 104 is installed relative to door frame 107 upon which wireless transceiver component 106 is installed, is operative to create changes in the magnetic field sensed by REED switch 200, and to thereby indicate opening of door 105.

As described hereinabove with reference to FIG. 1C, a tamper switch 160 is preferably provided on two-way transceiver element 116 for detecting disengaging of bottom housing element 114 of fixed magnetic contact wireless transceiver component 106 from two-way transceiver element 116 and thereby indicating possible tampering with wireless transceiver component 106.

An operator button 204 is preferably provided on two-way transceiver element 116 for initiating, by an operator of alarm system 108 of FIG. 1A, communication of wireless transceiver component 106 with alarm system 108 of FIG. 1A upon installation of wireless transceiver component 106 or upon maintenance thereof.

A battery engaging element 206 is provided for engaging a positive contact of battery 132 housed in housing element 130 of top housing element 112 (FIG. 1B).

An antenna 210 is provided on a top surface 212 of two-way transceiver element 116 for two-way communication between wireless transceiver component 106 and alarm system 108, and an antenna ground reference plane 214 is preferably provided on a bottom surface 216 of two-way transceiver element 116, generally opposite antenna 210. Antenna 210 is preferably a high frequency antenna operative for communicating, for example, at 868 or at 915 MHz. It is appreciated that the configuration of antenna ground reference plane 214 opposite antenna 210 is operative to improve the gain of antenna 210 and to diminish interfering effects of various materials, such as metals, disposed in the vicinity of wireless transceiver component 106. Such interfering effects may, for example, cause mistuning of antenna 210 or degradation of performance and range of antenna 210.

Apertures 218 and 219 are preferably formed in two-way transceiver element 116 for facilitating handling of two-way transceiver element 116 while in production thereof.

Turning now to FIG. 2B, it is shown that a LED indicator 220 is provided on top surface 212 of two-way transceiver element 116. LED indicator 220 is preferably operative to provide visual indications of the status of wireless transceiver component 106 to an operator via an aperture in top housing element 112. The visual indications may include, for example, an indication of communication signal strength of wireless transceiver component 106. LED indicator 220 is preferably operable to provide visual indications of various colors and may comprise, for example, three LED chips of different colors, such as red, yellow and green.

As further shown in FIG. 2B, transceiver circuit engaging elements 222 are preferably provided for engaging battery circuit engaging elements 140 of top housing element 112 when two-way transceiver element 116 is in engagement with top housing elements 112.

Figure 2C:
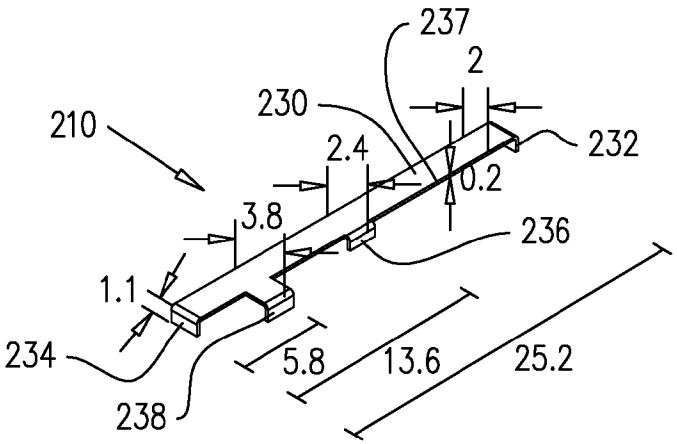
FIG. 2C is a simplified pictorial illustration of an antenna which is part of the two-way transceiver element of FIGS. 2A & 2B.

Reference is now made to FIG. 2C, which is a simplified pictorial illustration of antenna 210 which is part of two-way transceiver element 116 of FIGS. 2A & 2B. As shown in FIG. 2C, antenna 210 includes a flat elongate portion 230 having a length of 25.2 millimeters, a width of 2.0 millimeters and a thickness of 0.2 millimeters. Downward folded end portions 232 and 234, having a thickness of 0.2 millimeters and a width of 2.0 millimeters, extend downwardly 1.1 millimeters from corresponding ends of flat elongate portion 230. Downward folded end portion 232 is preferably connected via a capacitor to ground, and downward folded end portion 234 is preferably grounded.

A folded side portion 236 extends outwardly 0.4 millimeters and downwardly 0.9 millimeters from a side edge 237 of flat elongate portion 230. The distance between the far end of folded end portion 234 and an opposite far end of folded side portion 236 is 13.6 millimeters.

An extended folded side portion 238 extends outwardly 1.8 millimeters and downwardly 1.1 millimeters from side edge 237 of flat elongate portion 230. The distance between the far end of folded end portion 234 and an opposite far end of folded side portion 236 is 5.8 millimeters. Extended folded side portion 238 preferably serves as an input\output port of antenna 210.

Figure 2D:
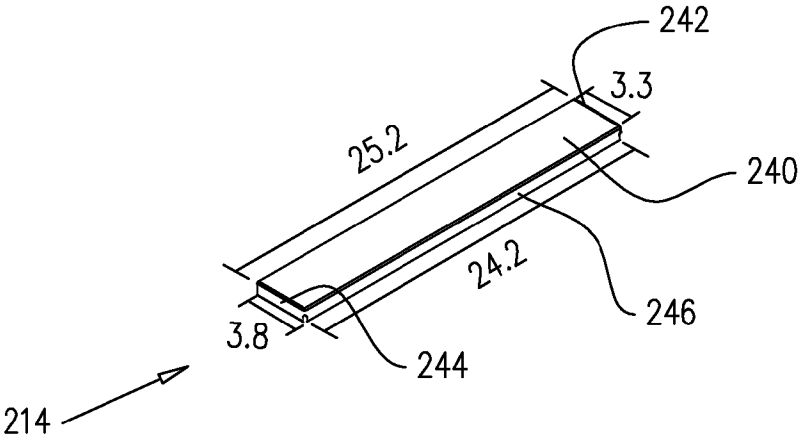
FIG. 2D is a simplified pictorial illustration of an antenna ground reference plane which is part of the two-way transceiver element of FIGS. 2A & 2B.

Reference is now made to FIG. 2D, which is a simplified pictorial illustration of antenna ground reference plane 214 which is part of two-way transceiver element 116 of FIGS. 2A & 2B. As shown in FIG. 2D, antenna ground reference plane 214 includes a flat elongate portion 240 having a length of 24.2 millimeters, a width of 3.3 millimeters and a thickness of 0.2 millimeters. Downward folded end portions 242 and 244, having a thickness of 0.2 millimeters, extend downwardly 1.1 millimeters from corresponding ends of flat elongate portion 240.

An elongate folded side portion 246 extends outwardly 0.5 millimeters and downwardly 1.1 millimeters from a side edge of flat elongate portion 240.

Figure 3A:
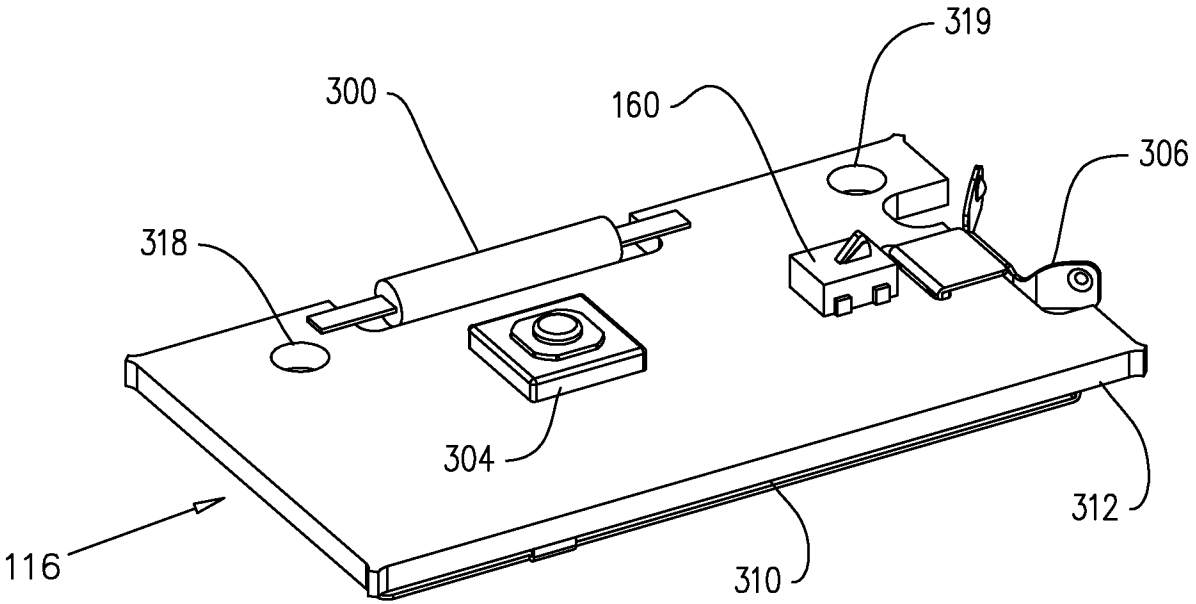
FIGS. 3A & 3B are simplified pictorial illustrations of a two-way transceiver element of the wireless door\window magnetic contact transceiver of FIGS. 1A-1C, constructed and operative in accordance with an alternative embodiment of the present invention.
Figure 3B:
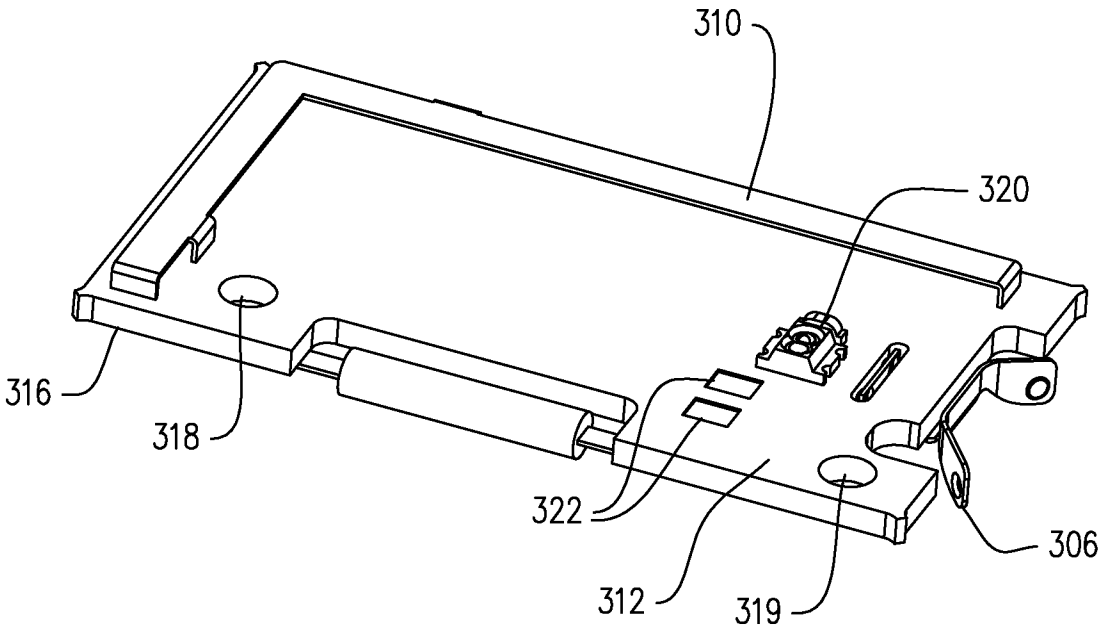

Reference is now made to FIGS. 3A & 3B, which are simplified pictorial illustrations of two-way transceiver element 116 of the wireless door\window magnetic contact transceiver of FIGS. 1A-1C, constructed and operative in accordance with an alternative embodiment of the present invention.

As shown in particular in FIG. 3A, a REED switch 300 is provided for sensing changes in a magnetic field induced by magnet component 104 of door intrusion detection assembly 100 (FIG. 1A). It is appreciated that opening of door 105 upon which magnet component 104 is installed relative to door frame 107 upon which wireless transceiver component 106 is installed, is operative to create changes in the magnetic field sensed by REED switch 300, and to thereby indicate opening of door 105.

As described hereinabove with reference to FIG. 1C, a tamper switch 160 is preferably provided on two-way transceiver element 116 for detecting disengaging of bottom housing element 114 of fixed magnetic contact wireless transceiver component 106 from two-way transceiver element 116 and thereby indicating possible tampering with wireless transceiver component 106.

An operator button 304 is preferably provided on two-way transceiver element 116 for initiating, by an operator of alarm system 108 of FIG. 1A, communication of wireless transceiver component 106 with alarm system 108 of FIG. 1A upon installation of wireless transceiver component 106 or upon maintenance thereof.

A battery engaging element 306 is provided for engaging a positive contact of battery 132 housed in housing element 130 of top housing element 112 (FIG. 1B).

Turning now to FIG. 3B, it is shown that an antenna 310 is provided on a top surface 312 of two-way transceiver element 116 for two-way communication between wireless transceiver component 106 and alarm system 108. Antenna 310 is preferably a low frequency antenna operative for communicating, for example, at 433 MHz.

Apertures 318 and 319 are preferably formed in two-way transceiver element 116 for facilitating handling of two-way transceiver element 116 while in production thereof.

A LED indicator 320 is provided on top surface 312 of two-way transceiver element 116. LED indicator 320 is preferably operative to provide visual indications of the status of wireless transceiver component 106 to an operator via an aperture in top housing element 112. The visual indications may include, for example, an indication of communication signal strength of wireless transceiver component 106. LED indicator 320 is preferably operable to provide visual indications of various colors and may comprise, for example, three LED chips of different colors, such as red, yellow and green.

As further shown in FIG. 3B, transceiver circuit engaging elements 322 are preferably provided for engaging battery circuit engaging elements 140 of top housing element 112 when two-way transceiver element 116 is in engagement with top housing elements 112.

Figure 3C:
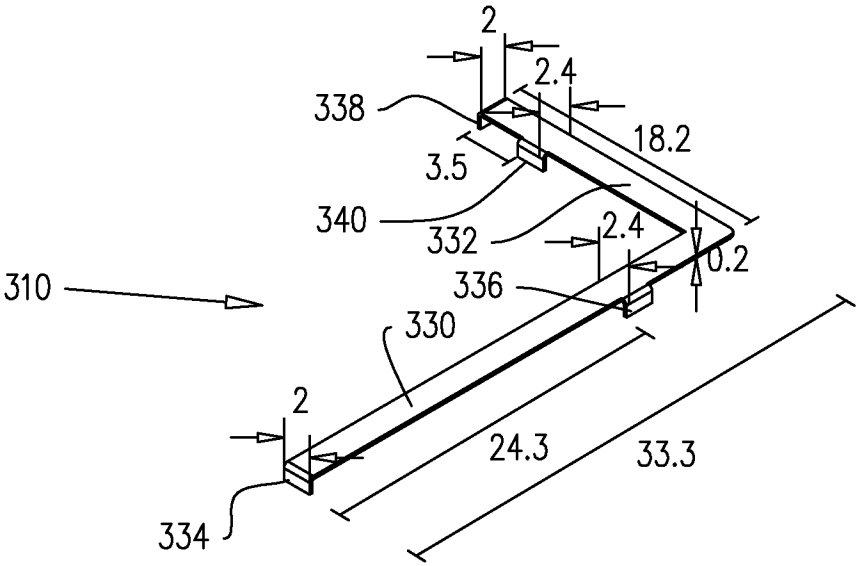
FIG. 3C is a simplified pictorial illustration of an antenna which is part of the two-way transceiver element of FIGS. 3A & 3B.

Reference is now made to FIG. 3C, which is a simplified pictorial illustration of antenna 310 which is part of the two-way transceiver element 116 of FIGS. 3A & 3B. As shown in FIG. 3C, antenna 310 is generally L-shaped, and includes a longer flat elongate portion 330 having a length of 33.3 millimeters and a width of 2.0 millimeters, and a shorter flat elongate portion 332, generally perpendicular to a longer flat elongate portion 330, and having a length of 18.2 millimeters and a width of 2.0 millimeters. Antenna 310 has a thickness of 0.2 millimeters.

Longer flat elongate portion 330 includes a downward folded end portion 334 having a width of 2.0 millimeters and a thickness of 0.2 millimeters, which extends downwardly 1.1 millimeters from an end of flat elongate portion 330. Downward folded end portion 334 is preferably connected via a capacitor to ground.

A folded side portion 336 extends outwardly 0.4 millimeters and downwardly 1.1 millimeters from an edge of flat elongate portion 330. The distance between the far end of folded end portion 334 and a near end of folded side portion 336 is 24.3 millimeters.

Shorter flat elongate portion 332 includes a downward folded end portion 338 having a width of 2.0 millimeters and a thickness of 0.2 millimeters, which extends downwardly 1.1 millimeters from an end of flat elongate portion 332. Downward folded end portion 338 is preferably grounded.

A folded side portion 340 extends outwardly 0.4 millimeters and downwardly 1.1 millimeters from an edge of flat elongate portion 332. The distance between the far end of folded end portion 338 and a near end of folded side portion 340 is 3.5 millimeters. Folded side portion 340 preferably serves as an input\output port of antenna 210.

It will be appreciated by persons skilled in the art that the present invention is not limited by what has been particularly shown and described hereinabove. Rather the scope of the present invention includes both combinations and subcombinations of the various features described hereinabove as well as modifications thereof which would occur to persons skilled in the art upon reading the foregoing description and which are not in the prior art.

The invention claimed is:

1. A fixed magnetic contact wireless transceiver comprising:

a two-way transceiver element adapted to be operable for two-way wireless communication between a fixed magnetic contact wireless transceiver component and an intrusion alarm system;

an antenna facilitating said two-way wireless communication between said fixed magnetic contact wireless transceiver component and said intrusion alarm system; and an antenna ground reference plane, opposite said antenna; wherein said antenna comprises:

a flat antenna elongate portion;

first and second downward folded antenna end portions extending downwardly from corresponding first and second ends of said flat antenna elongate portion;

a folded antenna side portion extending outwardly from a side edge of said flat antenna elongate portion; and an extended folded antenna side portion extending outwardly from said side edge of said flat antenna elongate portion.

2. A fixed magnetic contact wireless transceiver according to claim 1 and wherein said antenna ground reference plane comprises:

a flat ground reference plane elongate portion;

first and second downward folded ground reference plane end portions extending downwardly from corresponding first and second ends of said flat ground reference plane elongate portion; and an elongate folded ground reference plane side portion extending from a side edge of said flat ground reference plane elongate portion.

3. A fixed magnetic contact wireless transceiver according to claim 1 and wherein said flat antenna elongate portion has a volume of less than 11 cubic millimeters.

4. A fixed magnetic contact wireless transceiver according to claim 1 and wherein said flat antenna elongate portion has a volume of 10.08 cubic millimeters.

5. A fixed magnetic contact wireless transceiver according to claim 1 and wherein:

said flat antenna elongate portion has a length of less than 26 millimeters, a width of less than 3 millimeters and a thickness of less than 0.5 millimeters;

each of said first and second downward folded antenna end portions has a width of less than 2 millimeters and a thickness of less than 0.5 millimeters, and extends downwardly less than 1.5 millimeters from said corresponding first and second ends of said flat antenna elongate portion;

said folded antenna side portion extends outwardly less than 0.5 millimeters and downwardly less than 1 millimeter from said side edge of said flat antenna elongate portion, the distance between a far end of said second downward folded antenna end portion and an opposite far end of said folded antenna side portion being less than 14 millimeters; and said extended folded antenna side portion extends outwardly less than 2 millimeters and downwardly less than 1.5 millimeters from said side edge of said flat antenna elongate portion, the distance between said far end of said second folded antenna end portion and said opposite far end of said extended folded antenna side portion being less than 6 millimeters.

6. A fixed magnetic contact wireless transceiver according to claim 1 and wherein:

said flat antenna elongate portion has a length of 25.2 millimeters, a width of 2.0 millimeters and a thickness of 0.2 millimeters;

each of said first and second downward folded antenna end portions has a width of 2.0 millimeters and a thickness of 0.2 millimeters, and extends downwardly 1.1 millimeters from said corresponding first and second ends of said flat antenna elongate portion;

said folded antenna side portion extends outwardly 0.4 millimeters and downwardly 0.9 millimeters from said side edge of said flat antenna elongate portion, the distance between a far end of said second downward folded antenna end portion and an opposite far end of said folded antenna side portion being 13.6 millimeters; and said extended folded antenna side portion extends outwardly 1.8 millimeters and downwardly 1.1 millimeters from said side edge of said flat antenna elongate portion, the distance between said far end of said second folded antenna end portion and said opposite far end of said extended folded antenna side portion being 5.8 millimeters.

7. A fixed magnetic contact wireless transceiver according to claim 1 and wherein said first downward folded antenna end portion is connected via a capacitor to ground.

8. A fixed magnetic contact wireless transceiver according to claim 1 and wherein said second downward folded antenna end portion is grounded.

9. A fixed magnetic contact wireless transceiver according to claim 1 and wherein said extended folded antenna side portion serves as an input\output port of said antenna.

10. A fixed magnetic contact wireless transceiver according to claim 2 and wherein said flat ground reference plane elongate portion has a volume of less than 16 cubic millimeters.

11. A fixed magnetic contact wireless transceiver according to claim 2 and wherein said flat ground reference plane elongate portion has a volume of 15.972 cubic millimeters.

12. A fixed magnetic contact wireless transceiver according to claim 2 and wherein:

said flat ground reference plane elongate portion has a length of less than 25 millimeters, a width of less than 4 millimeters and a thickness of less than 0.5 millimeters;

each of said first and second downward folded end ground reference plane portions has a width of less than 4 millimeters and a thickness of less than 0.5 millimeters, and extends downwardly less than 1.5 millimeters from said corresponding first and second ends of said flat ground reference plane elongate portion; and said elongate folded ground reference plane side portion extends outwardly less than 1 millimeter and downwardly less than 1.5 millimeters from said side edge of said flat ground reference plane elongate portion.

13. A fixed magnetic contact wireless transceiver according to claim 2 and wherein:

said flat ground reference plane elongate portion has a length of 24.2 millimeters, a width of 3.3 millimeters and a thickness of 0.2 millimeters;

each of said first and second downward folded ground reference plane end portions has a width of 3.3 millimeters and a thickness of 0.2 millimeters, and extends downwardly 1.1 millimeters from said corresponding first and second ends of said flat ground reference plane elongate portion; and said elongate folded ground reference plane side portion extends outwardly 0.5 millimeters and downwardly 1.1 millimeters from said side edge of said flat ground reference plane elongate portion.

14. A fixed magnetic contact wireless transceiver according to claim 1 and also comprising a REED switch operable for:

sensing changes in a magnetic field induced by said magnet component, said changes being potentially indicative of an intrusion; and communicating indications of said changes to said alarm system via said two-way transceiver component.

15. A fixed magnetic contact wireless transceiver according to claim 1 and wherein said magnet component comprises a contact component installation marker for alignment thereof with a corresponding transceiver component installation marker comprised on said fixed magnetic contact wireless transceiver component, upon installation of said magnet component and said fixed magnetic contact wireless transceiver component.

16. A fixed magnetic contact wireless transceiver according to claim 1 and wherein said fixed magnetic contact wireless transceiver component also comprises top and bottom housing elements.

17. A fixed magnetic contact wireless transceiver according to claim 1 and wherein said fixed magnetic contact wireless transceiver component also comprises a recess which facilitates removal of said bottom housing element from said fixed magnetic contact wireless transceiver component.

18. A fixed magnetic contact wireless transceiver according to claim 16 and wherein said top housing element comprises at least one of at least one snap-in element and at least one retaining element integrally formed therein, for tightly retaining said two-way transceiver element within said top and bottom housing elements.

19. A fixed magnetic contact wireless transceiver according to claim 16 and wherein said top housing element comprises a battery housing element for housing a battery, and at least one of at least one snap-in element and at least one retaining element operable for retaining said battery within said battery housing.

20. A fixed magnetic contact wireless transceiver according to claim 19 and wherein said battery housing element comprises at least one battery engaging element and at least one battery circuit engaging element, and said two-way transceiver element comprises at least one transceiver circuit engaging element, said battery engaging element being operable for galvanically connecting a negative contact of said battery with said at least one battery circuit engaging element, said at least one battery circuit engaging element being operable for galvanic engagement with said at least one transceiver circuit engaging element of said two-way transceiver element upon enclosing said two-way transceiver element within said housing elements.

21. A fixed magnetic contact wireless transceiver according to claim 19 and wherein apertures for receiving said at least one of at least one snap-in element and at least one retaining element are formed in said bottom housing element.

22. A fixed magnetic contact wireless transceiver according to claim 19 and wherein apertures for facilitating fastening of said fixed magnetic contact wireless transceiver component to at least one of a door frame and a window frame are formed in said bottom housing element.

23. A fixed magnetic contact wireless transceiver according to claim 19 and wherein said fixed magnetic contact wireless transceiver component also comprises a tamper switch, wherein an attempt to tamper with said fixed magnetic contact wireless transceiver component results in toggling of said tamper switch.

24. A fixed magnetic contact wireless transceiver according to claim 19 and wherein said fixed magnetic contact wireless transceiver component also comprises an operator button operable for initiating, by an operator of said alarm system, communication of said fixed magnetic contact wireless transceiver component with said alarm system upon at least one of installation of said fixed magnetic contact wireless transceiver component and maintenance thereof.

25. A fixed magnetic contact wireless transceiver according to claim 19 and wherein said two-way transceiver element comprises a battery engaging element operable for engaging a positive contact of said battery.

26. A fixed magnetic contact wireless transceiver according to claim 1 and wherein said antenna is configured for high frequency communication with said alarm system, said high frequency being one of 868 MHz and 915 MHz.

27. A fixed magnetic contact wireless transceiver according to claim 1 and wherein said antenna ground reference plane opposite said antenna is operative to improve the gain of said antenna and to diminish interfering effects of materials disposed in a vicinity of said fixed magnetic contact wireless transceiver component.

28. A fixed magnetic contact wireless transceiver according to claim 1 and wherein said materials comprise metals, and said interfering effects comprise at least one of mistuning of said antenna, degradation of performance of said antenna and degradation of a range of said antenna.

29. A fixed magnetic contact wireless transceiver according to claim 1 and wherein said fixed magnetic contact wireless transceiver component also comprises a LED indicator operative to provide visual indications of a status of said fixed magnetic contact wireless transceiver component to an operator of said fixed magnetic contact wireless transceiver component.

30. A fixed magnetic contact wireless transceiver according to claim 29 and wherein said visual indications comprise an indication of communication signal strength of said fixed magnetic contact wireless transceiver component.

31. A fixed magnetic contact wireless transceiver according to claim 29 and wherein said LED indicator is operable to provide said visual indications in a multiplicity of colors.

32. A fixed magnetic contact wireless transceiver comprising:

a two-way transceiver component operable for two-way wireless communication between said fixed magnetic contact wireless transceiver component and an intrusion alarm system; and an L-shaped antenna facilitating said two-way wireless communication between said fixed magnetic contact wireless transceiver component and said intrusion alarm system, wherein said L-shaped antenna comprises:

a long flat elongate portion and a short flat elongate portion perpendicular to said long flat elongate portion;

a first downward folded end portion extending downwardly from an end of said long flat elongate portion;

a first folded side portion extending outwardly and downwardly from a side edge of said long flat elongate portion;

a second downward folded end portion extending downwardly from an end of said short flat elongate portion; and a second folded side portion extending outwardly and downwardly from a side edge of said short flat elongate portion.

33. A fixed magnetic contact wireless transceiver according to claim 32 and wherein said long flat elongate portion and said short flat elongate portion have a combined volume of less than 20 cubic millimeters.

34. A fixed magnetic contact wireless transceiver according to claim 32 and wherein said long flat elongate portion and said short flat elongate portion have a combined volume of 19.8 cubic millimeters.

35. A fixed magnetic contact wireless transceiver according to claim 32 and wherein:

said long flat elongate portion has a length of less than 34 millimeters, a width of less than 3 millimeters and a thickness of less than 0.5 millimeters; and said short flat elongate portion has a length of less than 19 millimeters, a width of less than 3 millimeters and a thickness of less than 0.5 millimeters.

36. A fixed magnetic contact wireless transceiver according to claim 32 and wherein:

said long flat elongate portion has a length of 33.3 millimeters, a width of 2.0 millimeters and a thickness of 0.2 millimeters; and said short flat elongate portion has a length of 18.2 millimeters, a width of 2.0 millimeters and a thickness of 0.2 millimeters.

37. A fixed magnetic contact wireless transceiver according to claim 32 and wherein:

said first downward folded end portion has a width of less than 3 millimeters and a thickness of less than 0.5 millimeters, and extends downwardly less than 1.5 millimeters from said end of said long flat elongate portion;

said first folded side portion extends outwardly less than 0.5 millimeters and downwardly less than 1.5 millimeters from said side edge of said long flat elongate portion, the distance between a far end of said first folded end portion and a near end of said first folded side portion being less than 25 millimeters;

said second downward folded end portion has a width of less than 3 millimeters and a thickness of less than 0.5 millimeters, and extends downwardly less than 1.5 millimeters from said end of said short flat elongate portion; and said second folded side portion extends outwardly less than 0.5 millimeters and downwardly less than 1.5 millimeters from said side edge of said short flat elongate portion, the distance between a far end of said second folded end portion and a near end of said second folded side portion being less than 4 millimeters.

38. A fixed magnetic contact wireless transceiver according to claim 32 and wherein:

said first downward folded end portion has a width of 2.0 millimeters and a thickness of 0.2 millimeters, and extends downwardly 1.1 millimeters from said end of said long flat elongate portion;

said first folded side portion extends outwardly 0.4 millimeters and downwardly 1.1 millimeters from said side edge of said long flat elongate portion, the distance between a far end of said first folded end portion and a near end of said first folded side portion being 24.3 millimeters;

said second downward folded end portion has a width of 2.0 millimeters and a thickness of 0.2 millimeters, and extends downwardly 1.1 millimeters from said end of said short flat elongate portion; and said second folded side portion extends outwardly 0.4 millimeters and downwardly 1.1 millimeters from said side edge of said short flat elongate portion, the distance between a far end of said second folded end portion and a near end of said second folded side portion being 3.5 millimeters.

39. A fixed magnetic contact wireless transceiver according to claim 32 and wherein said first downward folded end portion is connected via a capacitor to ground.

40. A fixed magnetic contact wireless transceiver according to claim 32 and wherein said second downward folded end portion is grounded.

41. A fixed magnetic contact wireless transceiver according to claim 32 and wherein said second folded side portion serves as an input\output port of said antenna.

42. A fixed magnetic contact wireless transceiver according to claim 32 and also comprising a REED switch operable for:

sensing changes in a magnetic field induced by said magnet component, said changes being potentially indicative of an intrusion; and communicating indications of said changes to said alarm system via said two-way transceiver component.

43. A fixed magnetic contact wireless transceiver according to claim 32 and wherein said magnet component comprises a contact component installation marker for alignment thereof with a corresponding transceiver component installation marker comprised on said fixed magnetic contact wireless transceiver component, upon installation of said magnet component and said fixed magnetic contact wireless transceiver component.

44. A fixed magnetic contact wireless transceiver according to claim 32 and wherein said fixed magnetic contact wireless transceiver component also comprises top and bottom housing elements.

45. A fixed magnetic contact wireless transceiver according to claim 32 and wherein said fixed magnetic contact wireless transceiver component also comprises a recess which facilitates removal of said bottom housing element from said fixed magnetic contact wireless transceiver component.

46. A fixed magnetic contact wireless transceiver according to claim 44 and wherein said top housing element comprises at least one of at least one snap-in element and at least one retaining element integrally formed therein, for tightly retaining said two-way transceiver element within said top and bottom housing elements.

47. A fixed magnetic contact wireless transceiver according to claim 44 and wherein said top housing element comprises a battery housing element for housing a battery, and at least one of at least one snap-in element and at least one retaining element operable for retaining said battery within said battery housing.

48. A fixed magnetic contact wireless transceiver according to claim 47 and wherein said battery housing element comprises at least one battery engaging element and at least one battery circuit engaging element, and said two-way transceiver element comprises at least one transceiver circuit engaging element, said battery engaging element being operable for galvanically connecting a negative contact of said battery with said at least one battery circuit engaging element, said at least one battery circuit engaging element being operable for galvanic engagement with said at least one transceiver circuit engaging element of said two-way transceiver element upon enclosing said two-way transceiver element within said housing elements.

49. A fixed magnetic contact wireless transceiver according to claim 47 and wherein apertures for receiving said at least one of at least one snap-in element and at least one retaining element are formed in said bottom housing element.

50. A fixed magnetic contact wireless transceiver according to claim 47 and wherein apertures for facilitating fastening of said fixed magnetic contact wireless transceiver component to at least one of a door frame and a window frame are formed in said bottom housing element.

51. A fixed magnetic contact wireless transceiver according to claim 47 and wherein said fixed magnetic contact wireless transceiver component also comprises a tamper switch, wherein an attempt to tamper with said fixed magnetic contact wireless transceiver component results in toggling of said tamper switch.

52. A fixed magnetic contact wireless transceiver according to claim 47 and wherein said fixed magnetic contact wireless transceiver component also comprises an operator button operable for initiating, by an operator of said alarm system, communication of said fixed magnetic contact wireless transceiver component with said alarm system upon at least one of installation of said fixed magnetic contact wireless transceiver component and maintenance thereof.

53. A fixed magnetic contact wireless transceiver according to claim 47 and wherein said two-way transceiver element comprises a battery engaging element operable for engaging a positive contact of said battery.

54. A fixed magnetic contact wireless transceiver according to claim 32 and wherein said antenna is configured for low frequency communication with said alarm system, said low frequency being 433 MHz.

55. A fixed magnetic contact wireless transceiver according to claim 32 and wherein said antenna ground reference plane opposite said antenna is operative to improve the gain of said antenna and to diminish interfering effects of materials disposed in a vicinity of said fixed magnetic contact wireless transceiver component.

56. A fixed magnetic contact wireless transceiver according to claim 32 and wherein said materials comprise metals, and said interfering effects comprise at least one of mistuning of said antenna, degradation of performance of said antenna and degradation of a range of said antenna.

57. A fixed magnetic contact wireless transceiver according to claim 32 and wherein said fixed magnetic contact wireless transceiver component also comprises a LED indicator operative to provide visual indications of a status of said fixed magnetic contact wireless transceiver component to an operator of said fixed magnetic contact wireless transceiver component.

58. A fixed magnetic contact wireless transceiver according to claim 57 and wherein said visual indications comprise an indication of communication signal strength of said fixed magnetic contact wireless transceiver component.

59. A fixed magnetic contact wireless transceiver according to claim 57 and wherein said LED indicator is operable to provide said visual indications in a multiplicity of colors.

* * * * *